US009820534B1

(12) United States Patent
Kelley

(10) Patent No.: US 9,820,534 B1
(45) Date of Patent: Nov. 21, 2017

(54) WIRELESS QUICK RELEASE BUCKLE

(71) Applicant: Todd A Kelley, Steubenville, OH (US)

(72) Inventor: Todd A Kelley, Steubenville, OH (US)

(73) Assignee: Todd A. Kelley, Mansfield, OH (US)

( * ) Notice: Subject to any disclaimer, the term of this patent is extended or adjusted under 35 U.S.C. 154(b) by 0 days.

(21) Appl. No.: 14/842,848

(22) Filed: Sep. 2, 2015

(51) Int. Cl.
*A44B 11/25* (2006.01)
*A44B 11/26* (2006.01)
*A44B 11/00* (2006.01)

(52) U.S. Cl.
CPC ..... *A44B 11/266* (2013.01); *A44B 11/006* (2013.01)

(58) Field of Classification Search
CPC ..... A44B 11/2523; A44B 11/2573; A44B 11/2569; B60R 2022/4883; B60R 2022/4816; B60R 22/48; B60R 22/325; Y10T 24/45466; Y10T 24/4566; Y10T 24/45623
USPC ..... 24/603, 614, 615
See application file for complete search history.

(56) References Cited

U.S. PATENT DOCUMENTS 5,182,836 A * 2/1993 Burkat ..... A44B 11/2573 24/603
5,274,890 A * 1/1994 Shimizu ..... A44B 11/2511 24/603
5,749,130 A * 5/1998 Bilyeu ..... A44B 11/2565 24/602
5,765,660 A * 6/1998 Ambrosi ..... B60R 22/322 180/268
5,815,895 A * 10/1998 Carlson ..... A44B 11/25 24/603
7,574,979 B2 * 8/2009 Nottingham ..... A01K 27/009 119/859
8,196,273 B2 * 6/2012 Anscher ..... A44B 11/266 24/265 BC
9,115,959 B2 * 8/2015 Hellweg ..... F41H 1/02
2002/0092140 A1 * 7/2002 Van Tassel ..... A44B 11/266 24/614
2006/0080812 A1 * 4/2006 O'Brien ..... A44B 11/25 24/633
2010/0313392 A1 * 12/2010 Anscher ..... A44B 11/266 24/616
2011/0030180 A1 * 2/2011 Parisi ..... A44B 11/2546 24/611
2011/0127307 A1 * 6/2011 Carter ..... F41H 1/02 224/271
2011/0239419 A1 * 10/2011 Carter ..... C07H 1/06 24/606
2012/0279028 A1 * 11/2012 Walega ..... A44B 11/2523 24/603

(Continued)

*Primary Examiner* — Robert J Sandy
*Assistant Examiner* — Rowland Do
(74) *Attorney, Agent, or Firm* — Todd A. Kelley; Brett Kelley; Marcus Kelley

(57) ABSTRACT

A wireless quick release buckle. The release buckle includes a male plug fastened into a female socket creating a locked buckle assembly. A wireless signal from a remote control is used to quickly release the male plug from the female socket. The male plug further includes springs, a lock rod and riveted hinges attached to plug arms; the hinges are secured to allow the plug arms to simultaneously move inward. The male plug further includes an actuation mechanism which includes a small motor and a receiver to receive a signal from the remote control which activates the actuation mechanism to thereby quickly release the buckle.

2 Claims, 4 Drawing Sheets

(56) References Cited

U.S. PATENT DOCUMENTS

| | | | | |
|---|---|---|---|---|
| 2014/0223703 | A1* | 8/2014 | Ammons | B60R 22/322<br>24/603 |
| 2015/0135493 | A1* | 5/2015 | O'brien | B60R 22/48<br>24/603 |

* cited by examiner

WIRELESS QUICK RELEASE BUCKLE

FIELD OF THE INVENTION

The present invention relates to a wireless quick release buckle in general. The present invention finds particular utility in connection with remotely controlling the release of certain equipment and devices used in sports and animal training. Accordingly, the invention will be disclosed and described in detail in connection with such equipment and devices. At the same time, it will be appreciated that the wireless quick release buckle can be used for selectively and remotely releasing components other than equipment and devices used in sports and animal training such as, for example, locking and unlocking doors and windows, general recreational activities, applications using Bluetooth technology on cellphones and watches, for military use of parachute release, and the like.

BACKGROUND OF THE INVENTION

In recent years, speed and endurance training devices have increased in popularity with individuals and amateur and professional sports teams. A wide variety of equipment and training regimens have been devised for athletes engaged in all sports, including soccer, ice hockey, track and field, football, basketball, baseball, swimming and the like. Athletes have employed weighted skid sleds strapped by a cord to a belt and pulled while running across a natural or artificial turf field or weighted skid sleds that are pushed. One of the more recently developed and popular training regimens involves using the wind or water for resistance through the use of a strapped-on air chute during running or "sea anchor" like, water chute during swimming. For example, a sport parachute (or drag chute) for use in speed and endurance enhancement training for athletes. This example can be referred to in U.S. Pat. No. 5,472,394 A which discloses an improved athletic training parachute. The parachutes help achieve different training goals such as speed endurance, strength endurance, start acceleration and explosiveness. The training parachute of U.S. Pat. No. 5,472,394 A references a quick release means for allowing a quick release of said parachute from the athlete's body during movement so that the drag provided by the inflated parachute may be released to effect an over-speed condition for enhanced speed training. The patents quick release referred to a large radio controlled transmitter from the model airplane remote control units manufactured by Futaba. Generally, the problems with these type of remote controls are; loses signal and the signal cuts in and out at unpredictable distances and wind occurrences, the need of an on/off power source switch, frequency disturbances, and alignment issues, thereby making the quick release aspect unreliable.

Specific restraints, equipment and devices which could benefit from a more reliable quick release mechanism include rodeo rider ropes, athletic resistance bands, animal collars and bungee cords. Other known restraints and handling devices could by developed to incorporate the quick release consistent with the present application.

U.S. Pat. No. 4,909,658 to Townsend discloses a bull rope incorporating a quick-release mechanism, the disclosure of which is incorporated herein by reference. The quick-release disclosed therein includes a spring biased latch arm and a main pivoting latch arm. As noted, this type of mechanical arrangement is prone to contamination and corrosion, and the mechanical moving parts often fail to function properly.

Also, the only means disclosed of actuating the release mechanism is by manually pulling the release cord.

U.S. Pat. No. 962,890 to Byrd at el. discloses a harness for controlling animals. A release mechanism is provided for the "operable ropes" of the restraint. The release is located along the lower side area of the animal, which is relatively difficult to access when the animal is standing. The release is activated by pressing a thumb piece, which requires the handler to position himself close to the animal in order to activate the release mechanism, thereby increasing the danger the handler will be kicked or otherwise harmed by the animal. Also, the release utilizes spring-biased mechanical parts which are susceptible to contamination, corrosion, and subsequent failure.

U.S. Pat. No. 5,107,410 to Wilson at al. discloses a releasable tether having a hook-shaped end and a spring-biased bolt closing member. The release mechanism includes a cable housed in a plastic tube. One end of the cable is connected to the bolt and the other end is connected to a trigger member. This release mechanism is rather complex, and includes moveable spring-biased parts which are prone to contamination, corrosion, and subsequent failure.

A radio controlled bucking strap release mechanism is disclosed in U.S. Pat. No. 3,733,530 to Labart, et al. As is well known, a bucking strap is applied to a horse or bull in the flank area thereof to cause the animal to buck more actively, such as in a bucking contest at a rodeo. The bucking strap is not gripped by the rider, and the purpose of the radio operated release is to disconnect the bucking strap and thus caine the animal so that it will stop bucking. Accordingly, the device does not help a rider release his hands from the bull rope. Moreover, the release mechanism includes a motor and a gear linkage arrangement that produces a lost motion, which would render the mechanism undesirably slow in operation.

SUMMARY OF THE INVENTION

In accordance with the embodied invention, this summary is provided to introduce a selection of concepts, in a simplified form, that are further described below in the Detailed Description. The wireless quick release buckle operates on the concept of having a buckle assembly comprised of a male plug that is fastened into a female socket creating a locked position and the male plug quickly releases upon receipt of a control signal from a remotely operated signal transmitter. Another concept is the provision of a quick release device of the foregoing characters having improved dependability and reliability. A further concept of the invention is the provision of a release mechanism which is more dependable and reliable in operation for releasing the buckle assembly and which is easier to reload following use than the release devices heretofore available. A further object of the invention is to provide improvement to a wide variety of equipment and training regimens devised for athletes engaged in all sports equipment such as the speed parachute, the buckle assembly can attach to resistance bands athletes use to increase vertical leap, military parachute and tactic training, martial art training apparatuses and other related equipment.

BRIEF DESCRIPTION OF THE DRAWINGS

The accompanying drawings illustrate the invention. In such drawings:

FIG. 6A illustrates an athlete with speed parachute with attached buckle assembly according to an exemplary embodiment.

FIG. 6B illustrates a rodeo/bull rider with attached buckle assembly according to an exemplary embodiment.

FIG. 6C illustrates a buckle assembly attached to the resistance bands on an athlete according to an exemplary embodiment.

DETAILED DESCRIPTION OF THE PREFERRED EMBODIMENTS

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
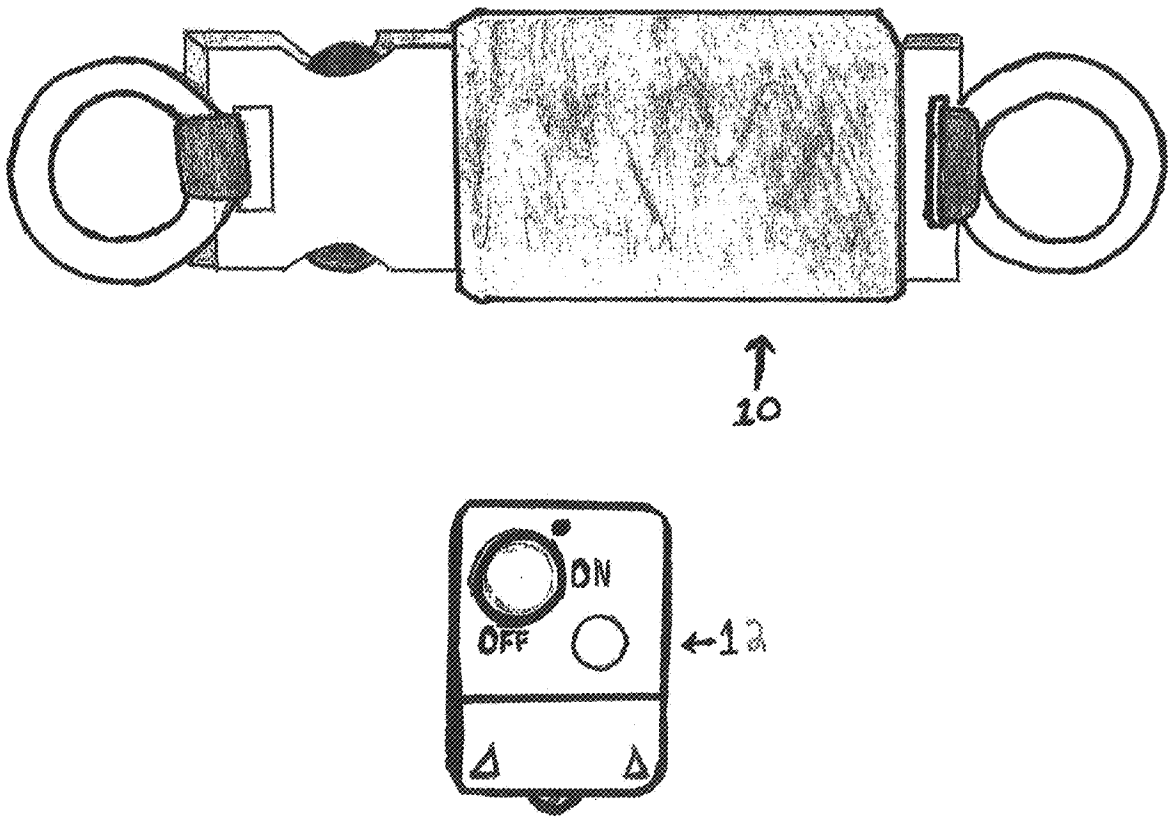
FIG. 1 is a perspective view illustrating a wireless quick release buckle assembly, including a remote control transmitter, a two-sided buckle (male plug and female socket) a strap casing, slide, and O-rings: Many different arrangements of the various components depicted in FIG. 1, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

FIG. 1 As shown in the drawings for purposes of illustration, the present invention of a wireless quick release buckle assembly referred to generally by the reference number 10. In general, the buckle assembly 10 includes a remote control transmitter 12, a female socket 14 with a nylon casing 40 supporting an O-ring 26, and a male plug 16 covered in a weaved strap casing 18, and attached with a nylon casing 40 enclosing another O-ring 26.

Figures 2, 3:
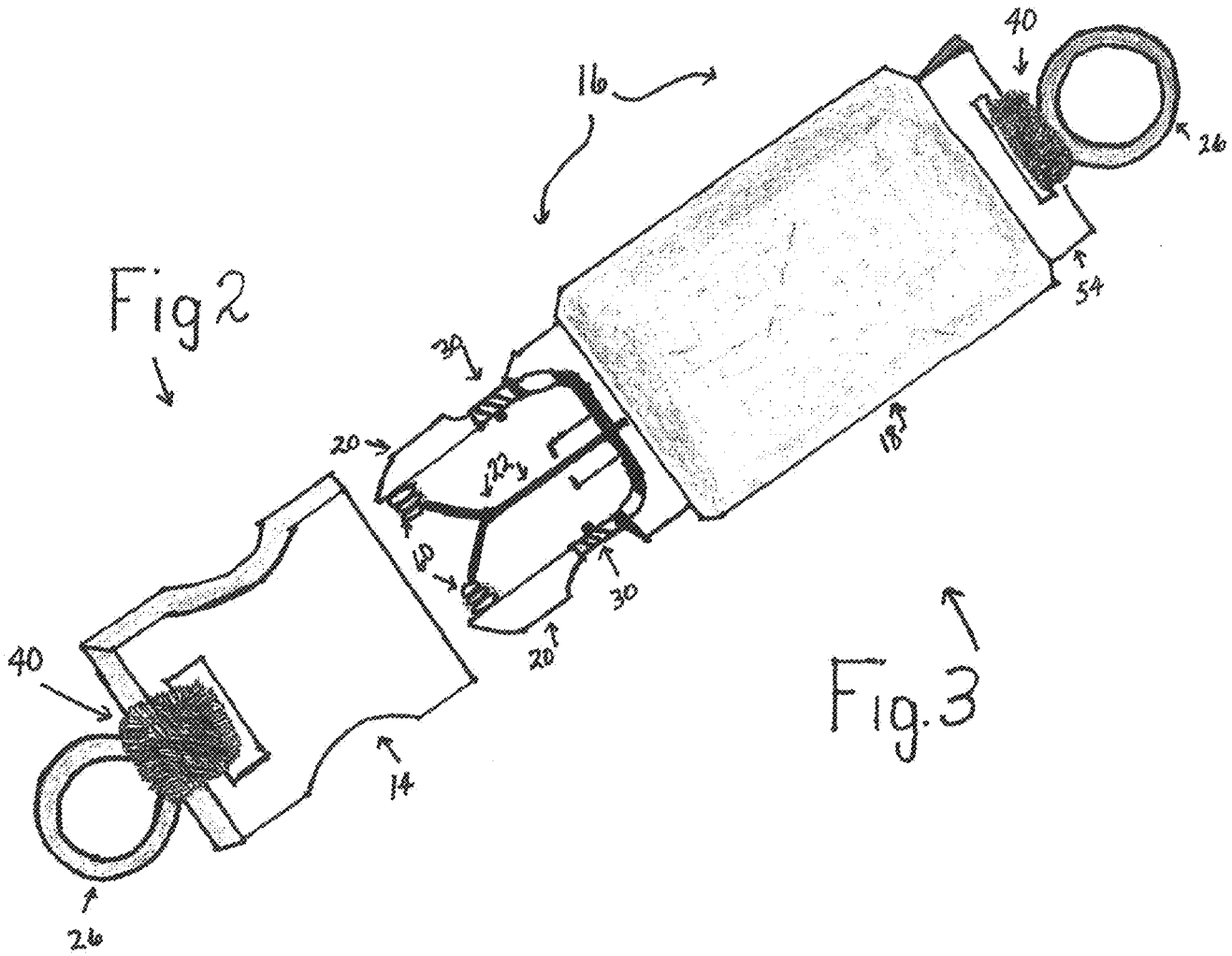
FIG. 2 is a perspective view of the female socket of the buckle.
FIG. 3 is a perspective view of the male plug of the buckle.

FIG. 2 is a general description of the female socket 14 which is a part of the side release buckle, commonly employed in standard bags, suitcases and pouches. The female socket 14 is attached with a nylon casing 40, supporting an O-ring 26.

FIG. 3 is the male plug 16 which is a part of the side release buckle, commonly employed in standard bags, suitcases and pouches, the male plug 16 is modified in a unique manner to offer a different use other than commonly employed. The male plug 16 is rather comprised of a heavy duty nylon strap casing 18 using tubular webbing. The arms 20 of the male plug are supported by riveted hinges 30, wherein the riveted hinges 30 secure the male plug arms 20 while allowing inward movement. The male plug 16 comprises a base portion 24, wherein the riveted hinges are placed between the male plug arms 20 and the base portion 24. Further, the male plug 16 comprises a locking mechanism to prevent the buckle from unlatching, wherein the locking mechanism includes a lock rod 22 having two free ends, and a spring 60 provided on each of the two free ends, each male plug arm 20 being attach to the locking mechanism by the two springs, wherein the lock rod 22 is movable between a locked position and an unlocked position using the riveted hinges 30 to force the male plug arms 20 to simultaneously move inward, therefore the male plug 16 is released from the female socket 14. Furthermore, the heavy duty nylon strap casing 18 is a highly abrasion resistant, thick weave hollow tubular design, and wherein the strap casing 18 offers great protection, high strength and flexibility. The strap casing 18 embeds a plastic slide 54 wherein the strap casing includes another O-ring 26 attached to a nylon strap 48 which allows other devices and equipment to be connected to the buckle assembly 10, wherein the O-rings 26 are made of lightweight polypropylene which offers durability and resistance to weather.

Figure 4:
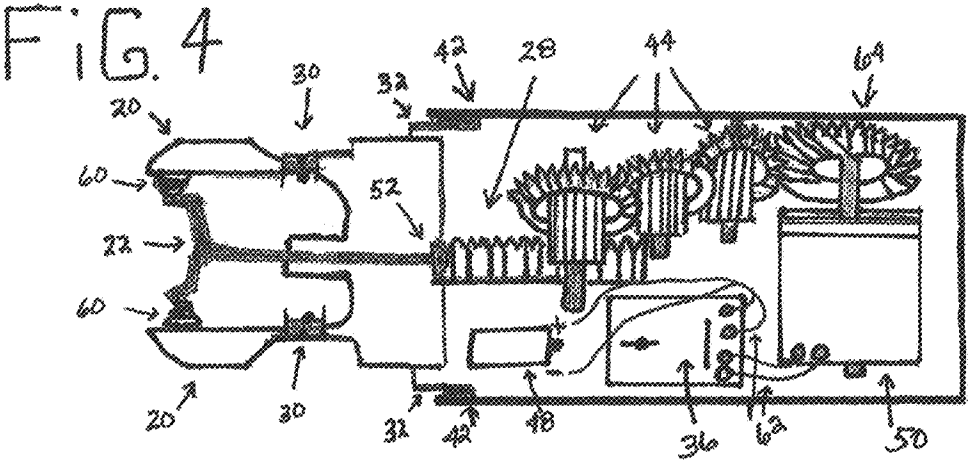
FIG. 4 is an enlarged view of the male plug and several internal components.

FIG. 4 shows a detailed view of the male plug 16 of the present invention further comprising a remotely actuated release mechanism configured to lock and release the male plug 16 from the female socket 14, wherein the actuated release mechanism includes an actuation system driven by mechanical and electrical components, the actuation system is adapted to be powered by a direct current that activates a receiver 36. The thick webbed layer of tubular strap casing 18 houses a metal frame 32 which is shaped to attach and secure the male plug 16 to an actuator box 42, and all its internal parts. The remote control 12 sends a signal to the receiver 36 to release the male plug from the locked position, the receiver 36 is wired 62 to a motor 50. Inside the actuator box 42 is the motor 50, the motor is equipped with a drive shaft anchoring a custom spur centrifugal clutch 64 which turns a series of three spur gears 44 that act as a gear reduction to a rack-and-pinion arm 28, wherein said rack-and-pinion arm 28 converts a rotational motion from the motor into a linear motion and is connected to the lock rod 22 for lock and quick release actions, the custom spur gears 44 are coupled to drive the rack and pinion gear arm 28. A rod post 52 is attached to the top of the rack and pinion gear arm 28 which is secured to the lock rod 22. The buckle is also configured to be manually released by applying pressure on the male plug arms 20.

Figure 5:
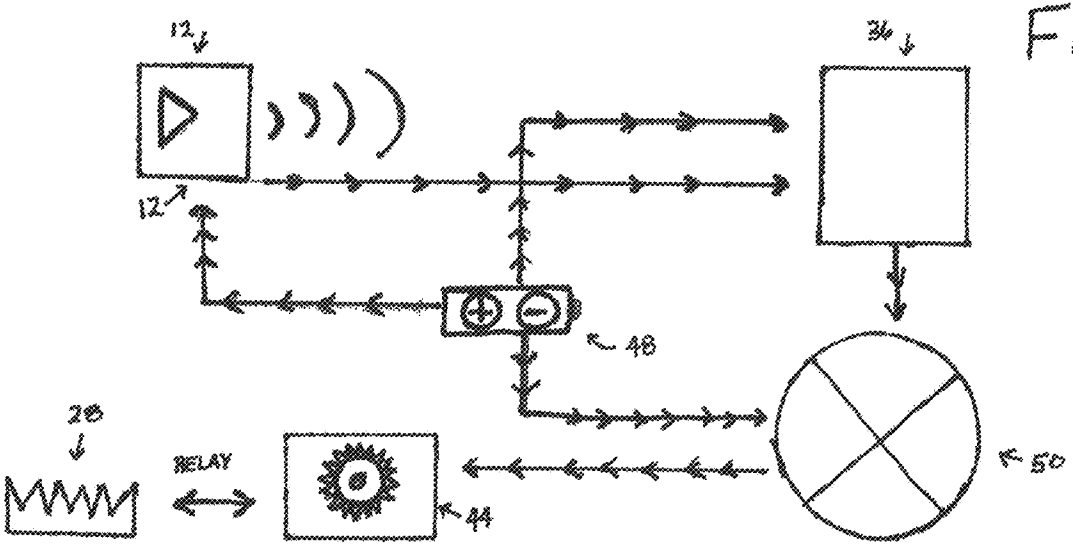
FIG. 5 is a block diagram of a wireless quick release buckle assembly according to an exemplary embodiment.

FIG. 5 is a block diagram of a remote controlled buckle assembly 10 shows a radio frequency remote control transmitting device 12 comprised of many electronic components, such as a Surface Acoustic Wave resonator which controls and stabilizes the transmitting frequency, and encoder which encodes the transmitting data, it transmits a signal using learning code, most learning remotes use a technology that ensures the memory is saved whenever you change the batteries. When the transmitter 12 is activated, it transmits a learning code signal to a receiver 36 such as a multi-channel relay board. When a learning code signal is received by the receiver 36, the RF passes through connectors and a DIP switch will trigger Relays ON/OFF. The DIP switch is wired to relay signal to a motor 50 of the actuator; the signal powers an actuation mechanism comprising the centrifugal clutch, gears, and a rack and pinion arm.

The block diagram of FIG. 5 shows only one possible configuration for the present invention, as any numbers of configurations are possible. For example, various size and shapes of the buckles can be created for large or smaller restraint needs, Bluetooth technology using wireless applications, other signals could be used such as light signals, sonic signals, etc.

FIG. 6 Accordingly, Exercises associated with the remote controlled buckle assembly 10 may vary depending on use and the desired workout routine. For example.

Figure 6A:
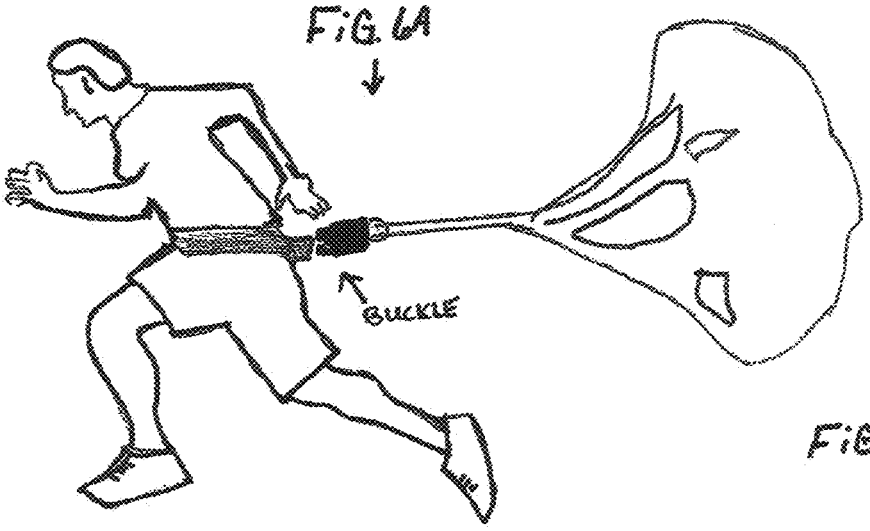
FIG. 6A to 6C illustrate alternative equipment and devices used with a wireless quick release buckle assembly.

FIG. 6A illustrates an athlete using a speed parachute device, the athlete is running to build up momentum and as he reaches a certain distance, a coach or the athlete uses a remote transmitter to quickly release buckle to create an overspeed effect according to an exemplary embodiment.

Figure 6B:
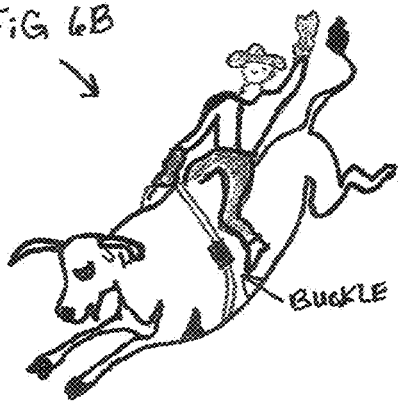

FIG. 6B illustrates a rodeo/bull rider with his hand secure around rope with the buckle assembly attached for quick release according to an exemplary embodiment.

Figure 6C:
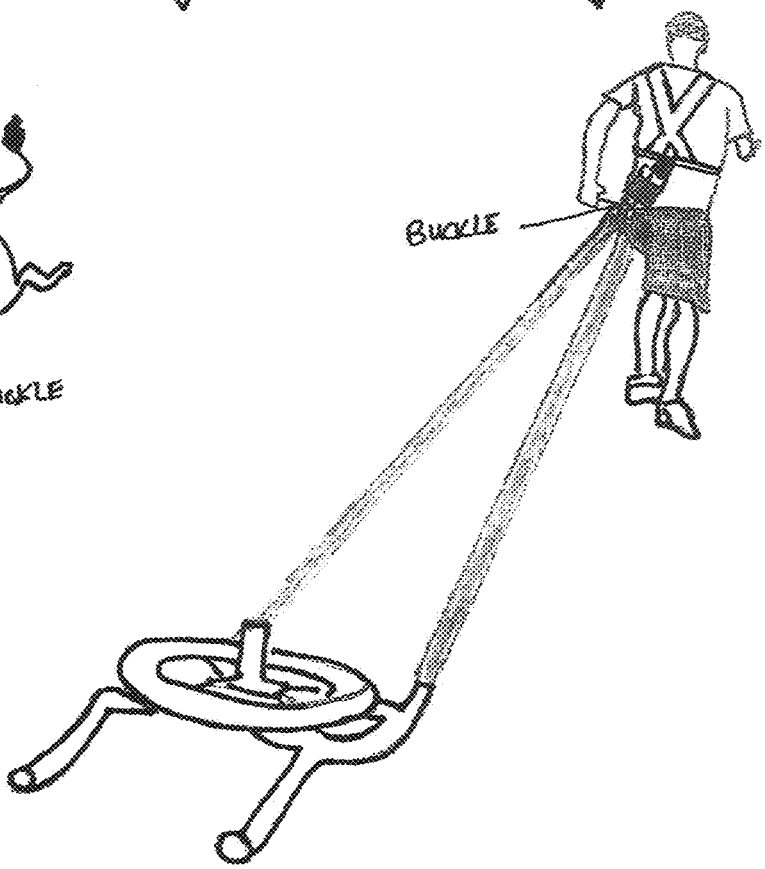

FIG. 6C illustrates an athlete using the resistance bands, the athlete is running to build up momentum and as he reaches a certain distance, a coach or the athlete uses a remote transmitter to quickly release buckle to create an overspeed effect according to an exemplary embodiment.

PARTS LIST FOR FIGS. 1-6

Buckle assembly 10
Remote control 12
Female socket 14
Male plug 16
Male strap casing 18
Male plug arms 20
Lock Rod 22
O-ring 26
Rack & Pinion gear arm 28
Riveted hinges 30
Metal frame 32
Power Source 34
Modulator/receiver 36
Nylon strap 40
Actuator box 42
Spur gears 44
Battery power source 48
Actuator motor 50
Rod post 52
Plastic slide 54
On/Off switch 56
Metal springs 60
Wiring 62
Centrifugal Clutch 64

The invention claimed is:

1. A remote controlled buckle assembly comprising:

a remote control transmitter;

a buckle comprising a male plug and a female socket, the male plug comprises a base portion, riveted hinges, male plug arms and a locking mechanism to prevent the buckle from unlatching, wherein the riveted hinges are placed between the male plug arms and the base portion, wherein the locking mechanism includes a lock rod having two free ends, and a spring provided on each of the two free ends, each male plug arm being attached to the locking mechanism by the two springs, wherein the lock rod is movable between a locked position and an unlocked position, wherein when the male plug arms simultaneously move inward, the male plug is released from the female socket, wherein the base portion of the male plug is partially assembled inside a heavy duty nylon strap casing using tubular webbing, wherein the strap casing is a highly abrasion resistant, thick weave hollow tubular design, and wherein the strap casing offers great protection, high strength and flexibility, wherein the strap casing comprises an O-ring made of lightweight polypropylene, wherein the O-ring is used to allow other devices and equipment to be connected to the buckle assembly, the strap casing further comprises a remotely actuated release mechanism configured to lock and release the male plug from the female socket, wherein the actuated release mechanism includes an actuation system driven by mechanical and electrical components, the actuation system is adapted to be powered by a direct current that activates a receiver, the mechanical and electrical components comprise: a motor that is equipped with a drive shaft anchoring a custom spur centrifugal clutch, the centrifugal clutch turns a series of three spur gears that act as a gear reduction to a rack-and-pinion arm, wherein said rack-and-pinion arm converts a rotational motion from the motor into a linear motion and is connected to the lock rod for lock and quick release actions; and wherein the buckle is also configured to be manually released by applying pressure on the male plug arms.

2. The remote controlled buckle assembly according to claim 1, wherein the remote controlled transmitter being selectively operable to transmit a signal to said receiver to release the male plug from the locked position.

* * * * *